US007299590B1

(12) United States Patent
Gibbs

(10) Patent No.: US 7,299,590 B1
(45) Date of Patent: Nov. 27, 2007

(54) APPARATUS AND METHOD FOR SETTING AND MAINTAINING THE DIMENSIONS OF A DOOR FRAME

(76) Inventor: Daniel B. Gibbs, 1533 N. Waterville Rd., Oconomowoc, WI (US) 53066

( * ) Notice: Subject to any disclaimer, the term of this patent is extended or adjusted under 35 U.S.C. 154(b) by 430 days.

(21) Appl. No.: 10/626,412

(22) Filed: Jul. 24, 2003

(51) Int. Cl.
*E04G 21/26* (2006.01)

(52) U.S. Cl. ..... 52/127.2; 52/213; 269/905; 248/351; 248/354.1; 248/354.3; 248/354.5; 248/354.6

(58) Field of Classification Search ..... 52/211–213, 52/217, 127.2, 127.4; 269/43, 242, 905; 248/125.8, 216.1, 351, 544, 354.1, 407; 33/194, 33/197, 404, 562, 667, 749.1
See application file for complete search history.

(56) References Cited

U.S. PATENT DOCUMENTS

| | | | | |
|---|---|---|---|---|
| 824,777 | A * | 7/1906 | Brooks | 269/43 |
| 1,793,035 | A * | 2/1931 | Whitney | 211/123 |
| 3,027,686 | A * | 4/1962 | Oates | 52/127.2 |
| 3,027,688 | A | 4/1962 | Oates | |
| 3,065,550 | A * | 11/1962 | Pattiani | 33/194 |
| 3,327,983 | A | 6/1967 | Snapp | |
| RE32,815 | E | 1/1989 | Smith | |
| 4,809,725 | A | 3/1989 | Champigny | |
| 4,829,727 | A * | 5/1989 | Kuzara, Jr. | 52/127.2 |
| 4,865,065 | A | 9/1989 | Chen | |
| 5,253,839 | A * | 10/1993 | McClure | 248/354.1 |
| 5,340,095 | A * | 8/1994 | Eicher, III | 269/43 |
| 5,377,462 | A | 1/1995 | Beals et al. | |
| 5,653,415 | A * | 8/1997 | Schworer | 248/354.1 |
| 6,282,852 | B1 | 9/2001 | Walcker | |
| 6,505,803 | B1 | 1/2003 | Hernandez | |
| 6,530,186 | B2 * | 3/2003 | Torstensen | 52/217 |

FOREIGN PATENT DOCUMENTS

| | | |
|---|---|---|
| CH | 620260 A5 | 11/1980 |
| DE | 4228195 | 8/1992 |

* cited by examiner

*Primary Examiner*—Jeanette Chapman
(74) *Attorney, Agent, or Firm*—Reinhart Boerner Van Deuren s.c.

(57) ABSTRACT

A device is disclosed for setting a door frame in position before adjacent walls are built and for maintaining the dimensions of the door frame during the building of the adjacent walls. The apparatus of the present invention generally includes two main components, specifically a first extension assembly and a second extension assembly. The first extension assembly and second extension assembly adjustably engage to provide a cost effective and efficient apparatus and method for setting a door frame in position before adjacent walls are built and for maintaining the dimensions of the door frame during the building of the adjacent walls. The apparatus is adjustable, lightweight, and easily portable by hand from worksite to worksite.

24 Claims, 3 Drawing Sheets

APPARATUS AND METHOD FOR SETTING AND MAINTAINING THE DIMENSIONS OF A DOOR FRAME

BACKGROUND OF THE INVENTION

Field of the Invention

The present invention relates generally to a cost effective and efficient apparatus and method for setting a door frame in position before adjacent walls are built, and more particularly to an apparatus and method for maintaining the dimensions of a door frame during the building of adjacent walls.

Most people take for granted the fact that doors easily and securely close. However, a door frame that has been improperly set and positioned will prevent a door mounted in that door frame from properly closing. Accordingly, it is important that in new construction workers precisely set and anchor a door frame in position before adjacent walls are built. Additionally, it is crucial that a set and anchored door frame maintain its precise dimensions during the building of the adjacent walls.

In most new construction, when door frames are received from the factory manufacturer, they are set in position before the adjacent walls are built. Generally, these factory door frames arrive with a disposable shipping member (referred to as "cleats") attached to their bottom ends. The cleats prevent the door frame's sidewalls, particularly the lower portions of the sidewalls, from bending and shifting out of shape during shipping.

Thus, the cleats only secure the door frame during shipping, and do not properly dimension the door frame during its installation. Nonetheless, inexperienced or hurried builders anchor the door frames at the shipped dimensions or by "eyeballing" them without first measuring. As a result, the door frame sidewalls can be positioned either too far inward or too far outward with the result being that a door installed in the door frame will not fit properly.

A second problem can arise even after a door frame has been properly dimensioned, set, and anchored. The dimensions between the door frame's sidewalls, from the floor upward, must be maintained at a precise, consistent width during the construction of the adjacent walls. Failure to ensure this proper dimensioning can cause the door frame's vertical sidewalls to bend inward.

To remedy improperly set door frames, builders must either "plane" the door or add "shims" between the hinges of the door and the door frame. However, planing and shimming proves to be very time consuming and expensive. Further, if a door frame's sidewalls are positioned too far inward or outward, planing and shimming may be inadequate. Consequently, a builder may have to tear apart the adjacent walls, reinstall the door frame, and rebuild the adjacent walls so that a door mounted in the door frame can properly and securely close.

The problems posed by improperly set or dimensioned door frames are numerous and well known within the construction industry. While numerous attempts have been made to solve both of these problems, none have proven to provide a cost effective, efficient, easy to use, and precise apparatus and/or method.

Builders have long used makeshift wooden spacers to properly dimension and set door frames. Generally, the spacers consist of a segment of two by four wood that is cut to correspond with the desired width, door jamb to door jamb, for each size of door frame. While using such segments of wood is indeed simple and cheap, it requires that builders cut different segments of wood for each different size of door frame. Because door frames commonly have widths that vary from twenty-four to seventy-two inches (typically increasing at two-inch intervals), builders must cut a different segment of wood for each different size of door frame. In short, carrying around and using a different segment of wood to properly dimension each different width of door frame proves very inefficient and cumbersome.

U.S. Pat. No. 3,027,686 to Oates (the "'686 patent") discloses an improved door frame setting and holding apparatus that is adjustable. The preferred embodiment of the '686 patent includes two adjustable "legs" for extension between different sizes of door frames, but no calibrated measuring indicia are contemplated or present on the apparatus. The absence of precisely calibrated measuring indicia makes it impossible for a user to precisely set a loose door frame at the required dimensions without performing a separate measurement. Consequently, the user will most likely overestimate or underestimate the proper door frame dimensions, causing a door that is installed in the door frame to improperly close. In addition, the device can move if bumped or dropped, changing a properly set dimension to an improper one.

Moreover, the preferred embodiment of the '686 patent can only be used with a partially erected wall adjacent to the set door frame. For example, the preferred embodiment includes two "heads," which perpendicularly fasten to an end of each leg, thus forming a "T." Each head abuts the door frame's opposing door stops. However, each head further includes a set of brackets, which extend from each head along the opposing sides of the partially erected adjacent walls.

In short, the brackets "sandwich" the wall. Once in place around the wall, the brackets are nailed to the partially erected adjacent wall, securing the door frame setter in place between each sidewall of the door frame. Thus, while the '686 patent provides an adjustable door frame setter apparatus, it fails to contemplate an apparatus that can be used to precisely set a door frame before adjacent walls are built. In addition, it is burdensome and time-consuming to use.

The apparatuses of U.S. Pat. No. 6,282,852 to Walker (the "'852 patent") and U.S. Pat. No. 6,530,186 to Torstensen (the "'186 patent") both attempt to provide a solution to properly set and anchor a door frame at specific and precise dimensions. Specifically, both apparatuses contemplate use for preparing a roughed out wooden door frame for receipt of a finished door frame.

The embodiments of the '852 patent and '186 patent consist of full-size door frame "outlines" that are inserted into roughed out wooden door frames. Once the roughed out wooden door frames have been properly positioned, the door frame outlines are removed. Only then can a finished door frame be inserted into the roughed out wooden door frame. However, neither the '852 patent or '186 patent contemplate subsequent use to ensure that a door frame maintains its proper dimensions during construction of adjacent walls.

Finally, both the '852 patent and the 1186 patent fail to provide a lightweight and easily portable apparatus. Instead, the embodiments are very large and cumbersome and expensive to produce. Accordingly, the embodiments cannot be easily transported or carried by a single user (i.e. in a 5-gallon job-tote bucket) from worksite to worksite.

The drawbacks of the known door frame setter apparatuses and methods have been apparent within the industry without any marked improvement to date. The previously known door frame setter apparatuses and methods have failed to provide a readily portable, inexpensive, and efficient apparatus and method for precisely setting a door frame in position before the adjacent walls are built. Moreover, the previously known embodiments have also failed to provide an apparatus and method for maintaining the dimensions of a door frame during the building of adjacent walls.

It is accordingly the primary objective of the present invention that it provide a cost effective and efficient apparatus and method for precisely setting and anchoring a door frame in position before the adjacent walls are built. It is a further objective of the present invention that it provide a cost effective and efficient apparatus and method for maintaining the dimensions of a door frame during the building of adjacent walls.

It is another objective of the present invention that it be adjustable and that it provide precisely calibrated measuring indicia to allow the door frame setter apparatus to efficiently and precisely adapt to any commonly known size of door frame. It is a related objective that the device once set not be susceptible to changing dimensions through being bumped or dropped.

It is yet another objective of the present invention that it be compact, rigid, lightweight, and readily portable so that a builder can efficiently transport it from worksite to worksite.

The door frame setter apparatus of the present invention must also be of construction which is both durable and long lasting, and it should also require little or no maintenance to be provided by the user throughout its operating lifetime. In order to enhance the market appeal of the door frame setter apparatus and method of the present invention, it should also be of inexpensive construction to thereby afford it the broadest possible market. Finally, it is also an objective that all of the aforesaid advantages and objectives be achieved without incurring any substantial relative disadvantage.

SUMMARY OF THE INVENTION

The disadvantages and limitations of the background art discussed above are overcome by the present invention. With this invention, a cost effective and efficient apparatus and method for setting a door frame in position before the adjacent walls are built is provided. The present invention further provides an apparatus and method for maintaining the dimensions of a door frame during the building of adjacent walls. Additionally, the door frame setter apparatus of the present invention is adjustable, lightweight, and easily portable by hand from worksite to worksite.

The door frame setter apparatus is of two-piece construction, specifically a first extension assembly and a second extension assembly. The first extension assembly includes a first head plate, a first arm, and a fastening device, such as a double end push button.

The first head plate of the first extension assembly is made of a generally rigid, but lightweight material, such as aluminum, rigid plastic, or any other suitable material. The first head plate includes a facing edge having a rectangular notch located therein. A positioning finger extends outward from one side of the facing edge of the first head plate while a smaller notch is located in the side of the head plate which is opposite the rectangular notch. The smaller notch thus receives and affixes to an end of the first arm.

The first arm of the present invention is a hollow tube and has a first end and a second end. Alternately, the first arm could have a different shape such as square, rectangular, triangular, oval, etc. The second end of the first arm includes a pair of diametrically opposed apertures and accommodates a fastening device, such as a double end push button.

The double end push button, which is V-shaped prior to insertion into the second end of the first arm, includes a first leg carrying a first button at the distal end thereof and a second leg carrying a second button at the distal end thereof. Double end push buttons are commonly used for adjustably raising and lowering the supports of aluminum crutches, wheelchair seatbacks, and the like. Such double end push buttons are generally manufactured from spring grade steel, which is a spring-like resilient material. However, other materials having spring-like qualities, such as plastic, can also be used.

The first extension assembly is assembled easily. First, the first end of the first arm is affixed to the smaller notch of the first head plate in any suitable manner, such as by welding, gluing, riveting, or by an interference fit. While it is preferred that the first arm and the first head plate are two separately assembled components, they can alternatively be formed unitarily using techniques such as stamping, molding (of plastic, for example), casting, or the like.

Finally, the double end push button is inserted into the second end of the first arm. Once in place within the second end of the first arm, the first and second buttons of the double end push button will be spring-biased to retractably protrude through the pair of diametrically opposed apertures and above the surface of the first arm.

The second extension assembly of the door frame setter apparatus includes two main components, specifically, a second head plate and a second arm. The second head plate is made of a generally lightweight material, such as aluminum, rigid plastic, or any other suitable material. The second head plate also includes a facing edge having a rectangular notch located therein. A positioning finger extends outward from one side of the facing edge of the second head plate while a smaller notch is opposite the rectangular notch located in the side of the second head plate that is opposite the rectangular notch. The smaller notch will receive and attach to one end of the second arm.

The second arm is a hollow tube and has a first end and a second end. Alternately, the first arm and the second arm could have different shapes such as square, rectangular, triangular, oval, etc. The second arm and the first arm must, however, have the same configuration since they will be mated together. The inner diameter of the second arm is slightly greater than the outer diameter of the first arm to allow the first arm to fit within the second arm.

The second arm further includes a plurality of spaced-apart pairs of diametrically opposed indexing apertures. The plurality of pairs of diametrically opposed indexing apertures are spaced longitudinally along the length of the second arm, preferably at two-inch intervals, and are adapted to receive the first button and the second button of the double end push button mounted in the first arm. Also present on the second arm is measuring indicia, which is used to indicate units of measure equivalent to commonly spaced apart door frame widths. Each measuring index thus corresponds to a specific pair of the plurality of pairs of diametrically opposed indexing apertures.

The second extension assembly is assembled much like the first extension assembly. The first end of the second arm is affixed to the smaller notch of the second head plate in any suitable manner, such as by welding, gluing, riveting, or by an interference fit. Alternatively, the second arm and the second head plate can be formed unitarily using techniques such as stamping, molding (of plastic, for example), casting, or the like.

Finally, the door frame setter apparatus is assembled by telescopically engaging the second end of the first extension assembly and the second end of the second extension assembly. A user first pushes inwardly on each of the first button and the second button of the double end push button. Pushing inwardly positions the first button and the second button at the outer surface of the first arm. This allows the second end of the first arm to be inserted into or adjusted within the second end of the second arm.

Once the first arm is inserted into and engaged with the second arm, the first arm can be rotated relative to the second arm (so that the first head plate and second head plate are not parallel with respect to each other) to maintain the first button and the second button of the double end push button at or below the surface of the first arm. Accordingly, this will allow the user to telescopically adjust the first arm within the second arm without interference from the plurality of pairs of diametrically opposed indexing apertures of the second arm.

After the user has adjusted the door frame setter apparatus to the desired length, the user can rotate the first arm back to its original position (so that the first head plate and the second head plate are parallel with respect to each other). This rotation will allow the first button and the second button of the double end push button to retractably protrude through the appropriate pair of the plurality of pairs of diametrically opposed indexing apertures, thereby preventing movement of the first arm relative to the second arm.

The present invention further includes a method for setting a door frame in position before adjacent walls are built. For example, the method includes extending the door frame setter apparatus to a precise, predetermined length in accordance with measuring indicia present upon the door frame setter apparatus; positioning and anchoring a first sidewall of a door frame to a surface, such as a floor; abutting the first head plate of the door frame setter apparatus against the first sidewall of the door frame; abutting a second sidewall of the door frame against the second head plate of the door frame setter apparatus; and anchoring the second sidewall of the door frame to the floor, the second sidewall being positioned at a precise separation from the first sidewall, as established by the door frame setter apparatus.

Finally, the present invention also includes a method for maintaining the dimensions of a door frame during the building of adjacent walls. The method includes extending the door frame setter apparatus to a precise, predetermined separation in accordance with measuring indicia present upon the door frame setter apparatus; abutting the first head plate of the door frame setter apparatus against a first sidewall of the door frame; abutting the second head plate of the door frame setter apparatus against a second sidewall of the door frame; and repeating the method as necessary to ensure that the first sidewall and the second sidewall do not shift inward during the building of adjacent walls.

It may therefore be seen that the present invention teaches a cost effective and efficient apparatus and method for setting a door frame in position before the adjacent walls are built. The present invention further teaches a cost effective and efficient apparatus and method for maintaining the dimensions of a door frame during the building of adjacent walls. Additionally, the door frame setter apparatus of the present invention is adjustable and provides precisely calibrated measuring indicia to allow the door frame setter apparatus to efficiently and precisely adapt to any commonly known size of door frame. Moreover, the door frame setter apparatus, once set, is not susceptible to changing dimensions through being bumped or being dropped. Further, the door frame setter apparatus is compact, rigid, lightweight and readily portable so that a builder can transport it from worksite to worksite.

The door frame setter apparatus of the present invention is of a construction which is both durable and long lasting, and which will require little or no maintenance to be provided by the user throughout its operating lifetime. The door frame setter apparatus of the present invention is also of inexpensive construction to enhance its market appeal and to thereby afford it the broadest possible market. Finally, all of the aforesaid advantages and objectives are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

Figure 1:
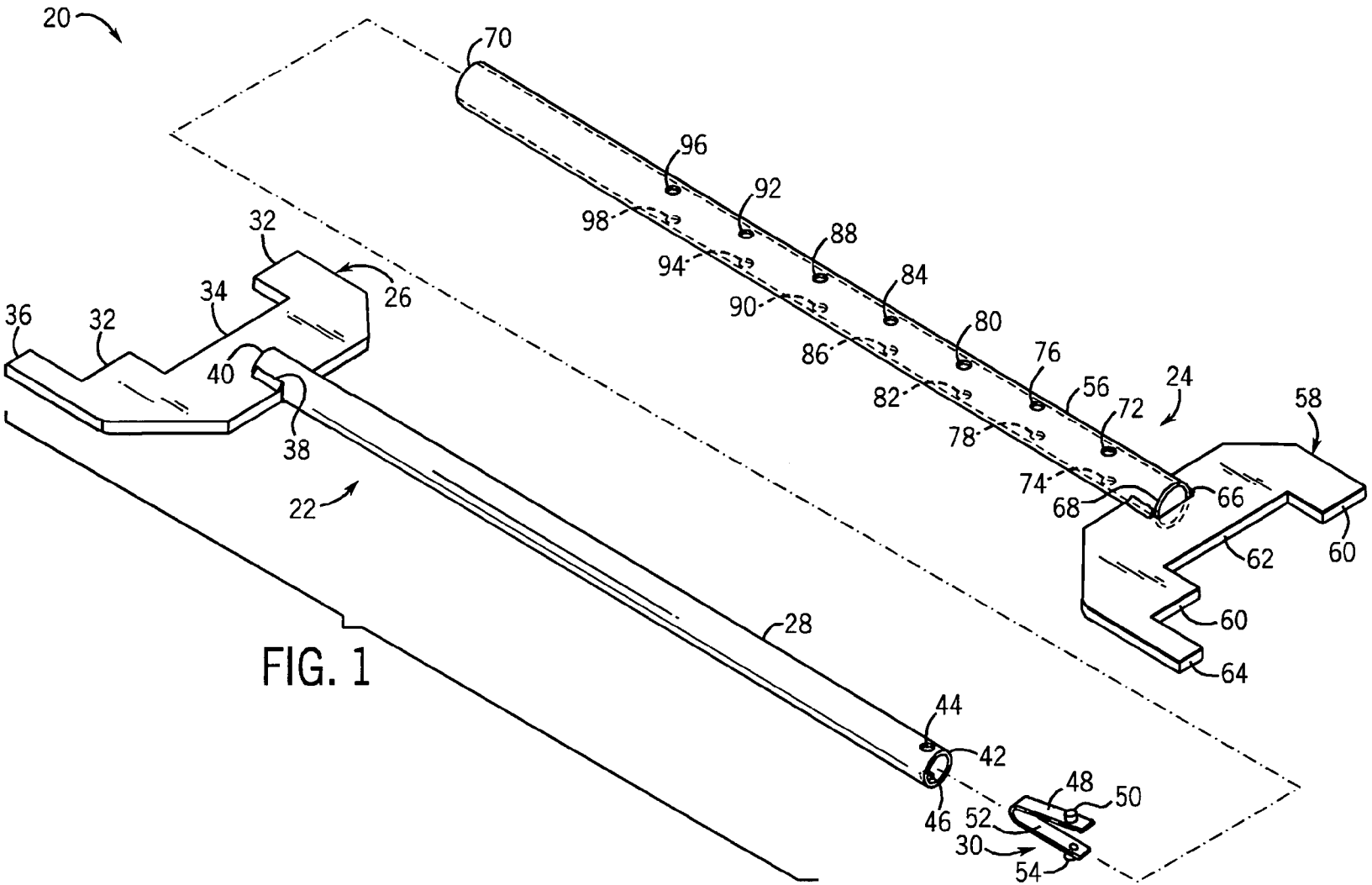
FIG. 1 is an exploded isometric view of a door frame setter apparatus constructed according to the teachings of the present invention.

The preferred embodiment of a door frame setter apparatus 20 of the present invention is depicted in FIG. 1. As illustrated, the door frame setter apparatus 20 generally includes a first extension assembly 22 and a second extension assembly 24.

Turning initially to the first extension assembly 22, it may be seen that it has three main components, which are a first head plate 26, a first arm 28, and a double end push button 30. The first head plate 26 includes a facing edge 32 having a rectangular notch 34 located therein. A positioning finger 36 extends outwardly from one side of the facing edge 32 of the head plate 26. Finally, opposite the rectangular notch 34 of the first head plate 26 is a smaller notch 38 for receiving an end of the first arm 28. It is preferred that the head plate 26 be manufactured from a rigid, lightweight material, such as aluminum, rigid plastic, or any other suitable material.

In practice, it is contemplated that the positioning finger 36 can be used in positioning and "squaring" the first head plate 26 about a vertical sidewall of a door frame (not shown in FIG. 1). Once squared, the facing edge 32 of the first head plate 26 will abut against the door jamb of the door frame's sidewall (also not shown in FIG. 1) while the rectangular notch 34 will accommodate the door frame's door stop (also not shown in FIG. 1). A more specific discussion of the functionality of the first head plate 26 will be discussed below in conjunction with FIG. 4.

The first arm 28 is, in the preferred embodiment, a hollow tube having a first end 40 and a second end 42. The first end 40 of the first arm 28 will be mounted in the smaller notch 38 of the first head plate 26. The second end 42 of the first arm 28 includes a pair of diametrically opposed apertures 44 and 46 defined transversely therethrough.

The second end 42 of the first arm 28 will accommodate the double end push button 30, which is a fastening device. The double end push button 30 is generally V-shaped prior to its insertion into the second end 42 of the first arm 28, and includes a first leg 48 having a first button 50 at the distal end thereof and a second leg 52 having a second button 54 at the distal end thereof. Such double end push buttons 30 are commonly used for adjustably raising and lowering the supports of aluminum crutches, wheelchair seatbacks, and the like. They are generally manufactured from spring grade steel, which is a spring-like resilient material. However, other materials having spring-like qualities, such as plastic, or the like, can also be used. Further, it will be appreciated that other types of adjustable fastening devices could instead be employed with the current invention.

In assembling the first extension assembly 22, the first end 40 of the first arm 28 is affixed to the smaller notch 38 of the first head plate 26. The notch 38 receives the first end 40 of the first arm 28, which is securely affixed thereto in any suitable way such as by welding, gluing, riveting, or by an interference fit. While it is preferred that the first arm 28 and the first head plate 26 be two separate components which are assembled, it will be appreciated that they could alternatively be formed unitarily using techniques such as stamping, molding (of plastic, for example), casting, or the like. Finally, the double end push button 30 is positioned within the second end 42 of the first arm 28 so that the first button 50 and the second button 54 retractably protrude through the pair of diametrically opposed apertures 44 and 46 and above the surface of the first arm 28.

Turning now to the second extension assembly 24 of FIG. 1, it may be seen that it has two main components, which are a second head plate 58 and a second arm 56. Like the first head plate 26, the second head plate 58 includes a facing edge 60 having a rectangular notch 62 located therein. Further, a positioning finger 64 extends outwardly from one side of the facing edge 60. A smaller notch 66 is located in the second head plate 58 opposite the rectangular notch 62. The smaller notch 66 is adapted to receive one end of the second arm 56. It is preferred that the head plate 58 be manufactured from a rigid, lightweight material, such as aluminum, rigid plastic, or any other suitable material.

Referring now specifically to the second arm 56, it can be seen that it is a hollow tube having a first end 68 and a second end 70. However, the first arm 28 and the second arm 56 are not limited to being round tubes, but could alternatively have different shapes such as square, rectangular, triangular, oval, etc. The inner diameter of the second arm 56 is slightly greater than the outer diameter of the first arm 28 to thereby allow the second end 42 of the first arm 28 to be inserted into the second end 70 of the second arm 56.

The second arm 56 further includes a plurality of pairs of diametrically opposed indexing apertures, such as apertures 72 and 74; apertures 76 and 78; apertures 80 and 82; apertures 84 and 86; apertures 88 and 90; apertures 92 and 94; and apertures 96 and 98. The plurality of pairs of diametrically opposed indexing apertures 72 and 74, 76 and 78, 80 and 82, 84 and 86, 88 and 90, 92 and 94, and 96 and 98 are spaced longitudinally along the length of the second arm 56 at uniform intervals, and are adapted to accommodate the first button 50 and the second button 54 of the double end push button 30.

Figure 2:
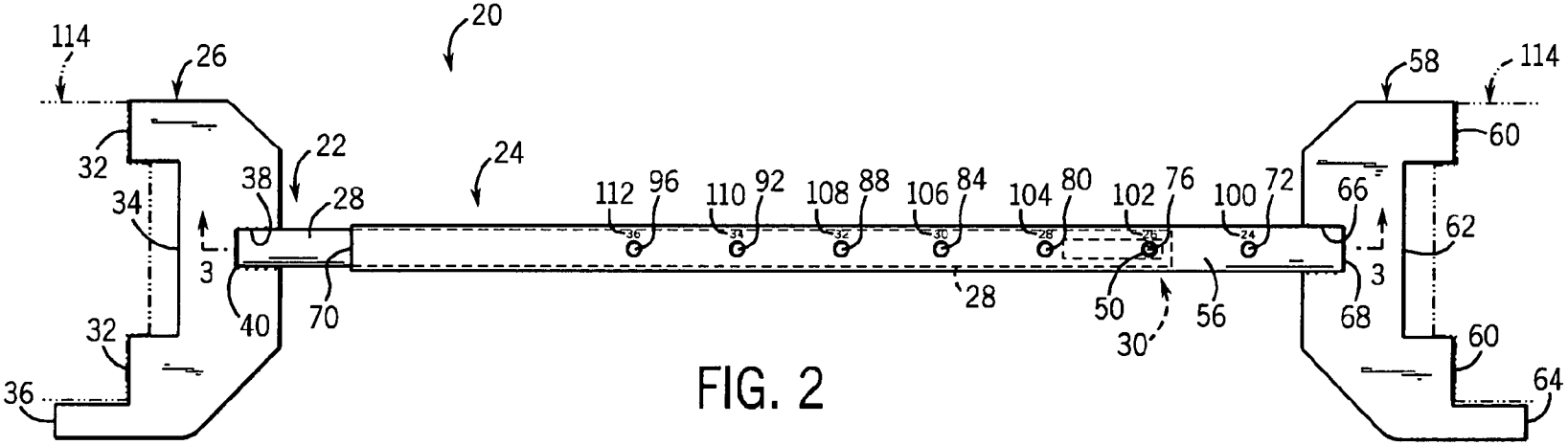
FIG. 2 is a top plan view of the assembled door frame setter apparatus shown in FIG. 1.

Turning now to FIG. 2, it is preferred that the longitudinal spacing between each of the plurality of pairs of diametrically opposed indexing apertures 72 and 74, 76 and 78, 80 and 82, 84 and 86, 88 and 90, 92 and 94, and 96 and 98 be two inches, as graphically indicated by the plurality of measuring indicia, such as a 24-inch mark 100, a 26-inch mark 102, a 28-inch mark 104, a 30-inch mark 106, a 32-inch mark 108, a 34-inch mark 110, and a 36-inch mark 112, present on second arm 56. Each one of the measuring indicia 100, 102, 104, 106, 108, 110, and 112 accompanies a corresponding pair of the plurality of pairs of diametrically opposed indexing apertures 72 and 74, 76 and 78, 80 and 82, 84 and 86, 88 and 90, 92 and 94, and 96 and 98, respectively. The measuring indicia 100, 102, 104, 106, 108, 110, and 112 thus indicate the desired width of a door frame dimension. With regard to the door frame setter apparatus 20, the measuring indicia correspond to the distance between the facing edge 32 of the first head plate 26 and the facing edge 60 of the second head plate 58.

Figure 3:
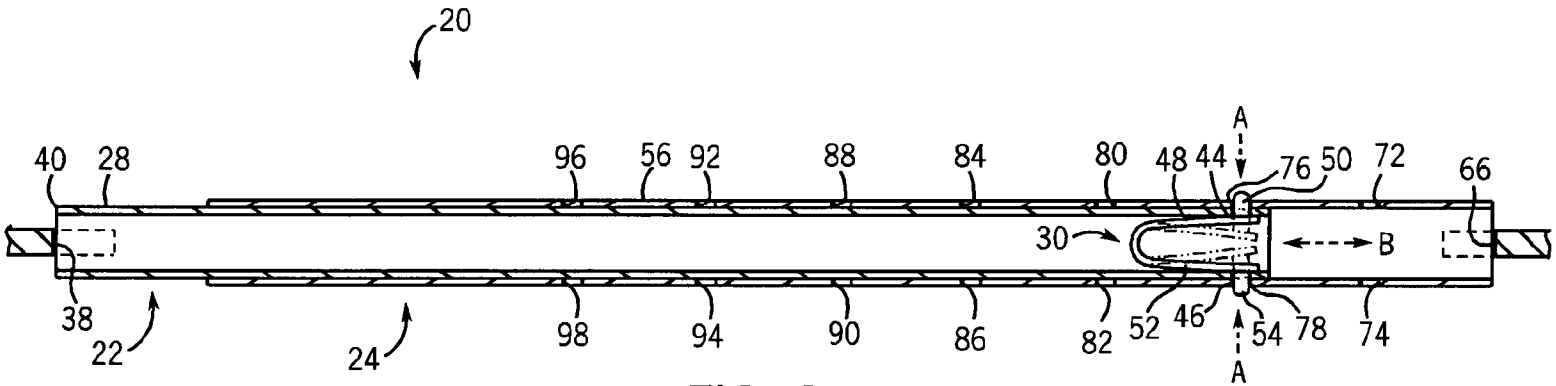
FIG. 3 is a cross sectional view of the door frame setter apparatus of FIG. 2, taken along lines 3-3.

Referring now to FIGS. 2 and 3, the assembled door frame setter apparatus 20 is shown. The door frame setter apparatus 20 is assembled by inserting the second end 72 of the first arm 28 into the second end 70 of the second arm 56. The first button 50 and second button 54 of the double end push button 30 must be pushed inwardly in the direction of arrows labeled "A." Pushing inwardly on the first button 50 and the second button 54 will position the first button 50 and the second button 54 at the outer surface of the first arm 28. This allows the first arm 28 to be inserted into or adjusted within the second arm 56.

Once the first arm 28 is engaged with the second arm 56, the first arm 28 may be rotated relative to the second arm 56 (so that the first and second head plates are not parallel with respect to each other). This rotation will maintain the first button 50 and the second button 54 at or below the outer surface of the first arm 28. Accordingly, the first arm 28 may be freely adjusted within the second arm 56 as indicated by the double-headed arrow labeled "B."

When the user has adjusted the door frame setter apparatus 20 to the desired length, the user can rotate the first arm 28 back 90 degrees to its original position (so that the first and second head plates are parallel with respect to each other). This will allow the first button 50 and the second button 54 to retractably protrude through the appropriate pair of the plurality of pairs of diametrically opposed indexing apertures 72 and 74, 76 and 78, 80 and 82, 84 and 86, 88 and 90, 92 and 94, and 96 and 98.

Figure 4:
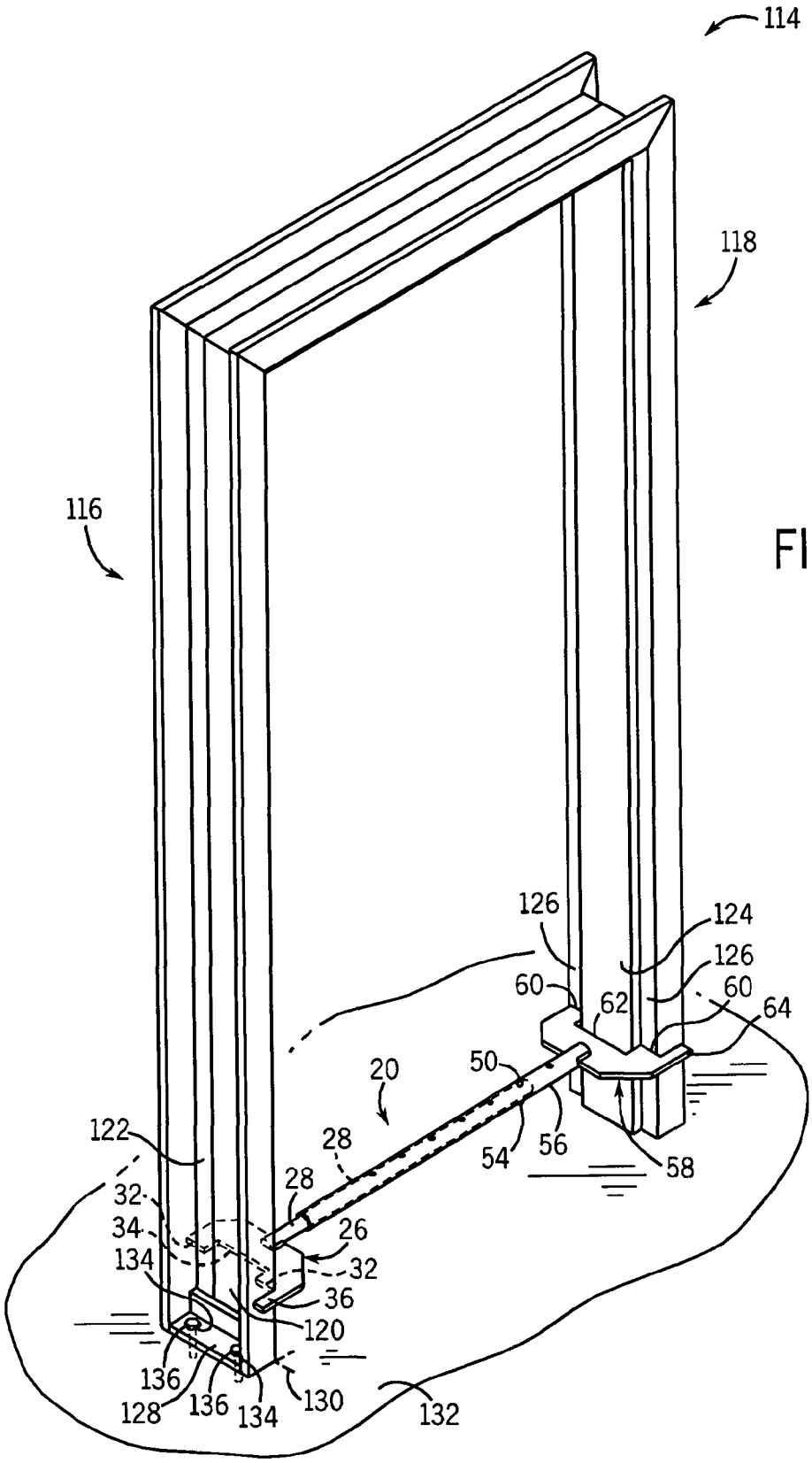
FIG. 4 is a perspective view of the door frame setter apparatus of FIG. 2 used to align a door frame as it is being set.

Referring finally to FIG. 4, the door frame setter apparatus 20 is shown being used in connection with a door frame 114, such as a hollow metal door frame. As illustrated, the door frame 114 generally includes a first sidewall 116 and a second sidewall 118. The first sidewall 116 includes a first door stop 120 mounted on the interior of a first door jamb 122 while the second sidewall 118 includes a second door stop 124 mounted on the interior of a second door jamb 126. The first sidewall 116 and the second sidewall 118 each also include an anchor plate at the bottom thereof, such as the anchor plate 128. The anchor plate 128 is welded in place within the first sidewall 116, and provides a "base" for anchoring the first sidewall 116 of the door frame 114 to a desired location indicated by a mark 130 on a floor 132.

The anchor plate 128 further includes apertures 134, which are located therein. The apertures 134 will receive fasteners 136, such as screws or bolts. Accordingly, when the first sidewall 116 is positioned at the mark 130 on the floor 132, the fasteners 136 can be driven through the fastening apertures 134 of the anchor plate 128 into the floor 132 below.

The manner in which the door frame setter apparatus 20 is used to set and anchor the door frame 114 before adjacent walls (not shown) are built, will now be described. The user will press inwardly on the first button 50 and the second button 54 of the double end push button 30 (not shown). Pressing inwardly on the first button 50 and the second button 54 will allow the user to longitudinally adjust the first arm 28 relative to the second arm 56.

For example, if the required door frame 114 width measures 26 inches, the user will adjust the second arm 56 so that the first button 50 and the second button 54 retractably protrude through the pair of plurality of pairs of diametrically opposed indexing apertures 76 and 78, located at the 26-inch mark 102 (not shown). Accordingly, the door frame setter apparatus 20 will be locked in place at a distance measuring 26 inches from the facing edge 32 of the first head plate 26 to the facing edge 60 of second head plate 58.

Next, the anchor plate 128 of the first sidewall 116 is positioned in accordance with a preferred mark 130 on the floor 132. Once correctly positioned, the anchor plate 128 and accompanying first sidewall 116 are securely fastened to the floor 132 with the fasteners 136. After the first sidewall 116 of the door frame 114 has been properly positioned and anchored to the floor 132, the door frame setter 20 will be used. The positioning finger 36 of the first head plate 26 will be placed against the front wall of the first sidewall 116 to squarely position the first head plate 26 about the first sidewall 116. Once squared, the user will abut the facing edge 32 of the first head plate 26 against the first door jamb 122 while the rectangular notch 34 accommodates the first door stop 120 of the first sidewall 116.

Next, while continuing to hold the first head plate 26 against the first sidewall 116, the user will pull the second sidewall 118 of the door frame 114 tightly against the second head plate 58 of the door frame setter apparatus 20. The positioning finger 64 will then be used to squarely position the second head plate 58 about the second sidewall 118 so that the facing edge 60 of the second head plate 58 abuts against the second door jamb 126 and the rectangular notch 62 accommodates the second door stop 124. The user can then secure the anchor plate (not shown) of the second sidewall 118 to the floor 132, thereby setting and anchoring the door frame 114 in position before the adjacent walls (not shown) are built around it.

The door frame setter apparatus 20 can also be used to prevent a door frame's 114 first sidewall 116 and second sidewall 118 from shifting or bending inward during the building of adjacent walls around the door frame 114. Specifically, while the adjacent walls are being built around the anchored door frame 114, the user will continue to check the width between the first sidewall 116 and the second sidewall 118. Accordingly, the user will frequently and repeatedly position the door frame setter apparatus 20 between the first sidewall 116 and the second sidewall 118, ensuring the maintenance of a proper width between the first sidewall 116 and the second sidewall 118 so that a later-hung door will properly close.

It may therefore be appreciated from the above detailed description of the preferred embodiment of the present invention that it provides a cost effective and efficient apparatus and method for precisely setting and anchoring a door frame in position before adjacent walls are built. Further, the present invention provides a cost effective and efficient apparatus and method for preventing a door frame's sidewalls from shifting inward during the building of the adjacent walls.

Additionally, the preferred embodiment of the present invention is adjustable and precisely calibrated with measuring indicia so as to efficiently and precisely adapt to any commonly known door frame. Finally, the present invention is rigid, lightweight, and readily portable so that a builder can efficiently transport it from worksite to worksite.

Although an exemplary embodiment of the door frame setter apparatus and method has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. An apparatus for setting and maintaining the dimensions of a door frame having opposing first and second sidewalls each having a doorstop mounted thereupon, comprising;

a first head plate including a first facing edge for engagement with a first sidewall of a door frame, said first facing edge having a notch located therein for admitting a first doorstop mounted on the first sidewall of the door frame:

a first arm connected to said first head plate at a side opposite said first facing edge;

a second head plate including a second facing edge for engagement with a second sidewall of the door frame, said second facing edge having a notch located therein for admitting a second doorstop mounted on the second sidewall of the door frame:

a second arm connected to said second head plate at a side opposite said second facing edge, said second arm being adjustably engageable with said first arm, one of said first arm and said second arm including a plurality of indexing apertures located at uniformly longitudinally spaced-apart positions on said one of said first arm and said second arm; and an adjustment mechanism associated with the other of said first arm and said second arm, said adjustment mechanism comprising at least one retractably engageable member for selectively releasable engagement with a selected one of said plurality of uniformly longitudinally spaced-apart indexing apertures to lock said first arm in a corresponding one of a plurality of discrete uniformly longitudinally spaced-apart positions relative to said second arm to thereby establish the distance between said first and second facing edges, wherein said plurality of discrete uniformly longitudinally spaced-apart positions allowing said apparatus to be used to facilitate the installation of door frames to accommodate doors having one of a plurality of standard widths.

2. The apparatus as defined in claim 1, wherein at least one of said first arm an said second arm include measuring indicia located thereon.

3. The apparatus as defined in claim 2, wherein said measuring indicia are longitudinally spaced at two-inch intervals along one of said first arm and said second arm.

4. The apparatus as defined in claim 1, wherein said plurality of uniformly longitudinally spaced-apart indexing apertures comprise a series of diametrically opposed pairs of indexing apertures, wherein each of said diametrically opposed pair of indexing apertures is uniformly spaced-apart from each adjustment diametrically opposed pair of indexing apertures.

5. The apparatus as defined in claim 4, wherein said other of said first arm and said second arm comprises a pair of diametrically opposed apertures defined transversely therethrough, said adjustment mechanism comprising a pair of retractably engageable members located in said pair of diametrically opposed apertures, said retractably engageable members being biased to retractably extend through said pair of diametrically opposed apertures and retractably engage a selected pair of said uniformly longitudinally spaced-apart diametrically opposed pairs of indexing apertures in said one of said first arm and said second arm.

6. The apparatus as defined in claim 1, wherein said first head plate further includes a positioning finger extending outward from a side of said facing edge in a direction opposites said connection to said first arm, and wherein said second head plate further includes a positioning finger extending toward from a side of said facing edge in a direction opposite said connection to said second arm.

7. The apparatus as defined in claim 1, wherein said first arm is telescopically engaged with said second arm, at least a portion of said one of said first arm and said second arm fitting within said other of said first arm and said second arm.

8. An apparatus for setting and maintaining the dimensions of a door frame, comprising;

a first head plate, wherein said first head plate includes a facing edge defining a notch and a positioning finger extending outward from a side of said facing edge;

a first hollow arm, said first hollow arm having a first end and a second end, wherein said first end is connected to said first head plate opposite said notch:

a second head plate, wherein said second head plate includes a facing edge defining a notch and a positioning finger extending outward from a side of said facing edge;

a second hollow arm, said second hollow arm having a first end and a second end, wherein said first end is connected to said second head plate opposite said notch, and wherein said first hollow arm and said second hollow arm are telescopically engaged at said second ends;

a plurality of uniformly longitudinally spaced-apart pairs of diametrically opposed apertures longitudinally spaced along a length of said second hollow arm:

measuring indicia located on said second hollow arm and corresponding to each of said plurality of pairs of diametrically opposed apertures; and an adjustment mechanism disposed within said second end of said first hollow arm, said adjustment mechanism being biased to retractably engage one of said plurality of uniformly longitudinally spaced-apart pairs of diametrically opposed apertures for locking said first hollow arm in any of a plurality of positions relative to said second hollow arm, said plurality of positions allowing the apparatus to be used with door frames having a plurality of dimensions.

9. An apparatus for setting and maintaining the dimensions of a door frame having opposing first and second sidewalls, comprising;

a first extension assembly, said first extension assembly including a first head plate including a first facing edge, said first facing edge of said first plate for engagement with a first sidewall of a door frame;

a second extension assembly, said second extension assembly including a second head plate including a second facing edge, said second facing edge of said second head plate for engagement with a second sidewall of the door frame opposite the first sidewall of the door frame, said second extension assembly being adjustably engageable with said first extension in a manner whereby the distance between said first facing edge and said second facing edge can be varied; and an adjustment mechanism associated with said first extension assembly and said second assembly to allowed he distance between said first facing edge and said second facing edge to be set to a desired one of a plurality of discrete uniformly longitudinally spaced-apart distances to facilitate the installation of door frames to accommodate doors having one of a plurality of standard widths.

10. The apparatus as defined in claim 9, wherein at least one of said first arm and said second arm includes measuring indicia located thereon.

11. The apparatus as defined in claim 10, wherein said measuring indicia are longitudinally spaced at two-inch intervals along one of said first extension assembly and said second extension assembly.

12. The apparatus as defined in claim 9, wherein said first extension assembly further comprises a first arm, and wherein said second extension assembly further comprises a second arm, said first arm being connected to said first head plate on a side opposite said first facing edge an said second arm being connected to said second head plate on a side opposite said second facing edge, one of said first and second arms comprising a plurality of uniformly longitudinally spaced-apart indexing apertures and the other of said first and second arms comprising an adjustment mechanism comprising at least one retractably engageable member for selectively releasable engagement with a selected one of said plurality of uniformly longitudinally spaced-apart indexing apertures to lock si ad first arm in a corresponding one of a plurality of discrete uniformly longitudinally spaced-apart portions relative to said second arm to thereby establish the distance between said first and second facing edges.

13. The apparatus as defined in clam 12, wherein said first facing edge has a notch located therein for admitting a first doorstop mounted on the first sidewall of the door frame and wherein said second facing edge has a notch located therein for admitting a second doorstop mounted on the second sidewall of the door frame.

14. The apparatus as defined in claim 13, wherein said first head plate further includes a positioning finger extending outward from a side of said facing edge in a direction opposite said connection to said first arm, and wherein said second head plate further include a positioning finger extending outward from a side of said facing edge in a direction opposite said connection to said second arm.

15. The apparatus as defined in claim 13, wherein said first arm includes a first end and a second end, and wherein said second arm includes a first end and a second end, said first end of said first arm connected to said first head plate at a side opposite said notch and said first end of said second arm connected to said second head plate at a side opposite said notch, said second end of said first arm adjustably engaged with said second end of said second arm.

16. The apparatus as defined in claim 15, wherein at least one of said first arm and said second arm is hollow.

17. The apparatus as defined in claim 16, wherein said hollow arm has an inner diameter greater than an outer diameter of the other arm of said first arm and said second arm.

18. The apparatus as defined in claim 17, wherein said second end of said first arm is telescopically engaged with said second end of said second arm, at least a portion of one of said second end of said first arm and said second end of said second arm fitting within the other of second end of said first arm and said second end of said second arm.

19. The apparatus as defined in claim 18, wherein one of said first arm and said second arm comprises a plurality of uniformally longitudinally spaced-apart indexing apertures, and wherein the other of said first arm and said second arm further includes a pair of diametrically opposed apertures defined transversely through said second end, an adjustment mechanism being disposed between said pair of diametrically opposed apertures, at least a portion of said adjustment mechanism being biased to retractably extend though said pair of diametrically opposed apertures and retractably engage said plurality of uniformly longitudinally spaced-apart indexing apertures.

20. The apparatus as defined in claim 19, wherein said retractable engagement of said adjustment mechanism with said plurality of uniformly longitudinally spaced-apart indexing apertures locks said first arm in any of a plurality of uniformly longitudinally spaced-apart positions relative to said second arm, said plurality of uniformly longitudinally spaced-apart positions allowing the apparatus to be used with door frames having a plurality of dimensions.

21. The apparatus as defined in claim 19, wherein said plurality of uniformly longitudinally spaced-apart indexing apertures are diametrically opposed pairs of indexing apertures longitudinally spaced at two-inch intervals along a length of at least one of said first extensions assembly and said second extension assembly.

22. A method of setting and maintaining the dimensions of a door frame having opposing first and second sidewalls each having a doorstep mounted thereupon, comprising the steps of:

positioning and anchoring a first sidewall of the door frame to a surface;

providing first head plate including a first facing edge for engagement with a first sidewall of a door frame and a second head plate including a second facing edge for engagement with a second sidewall of the door frame, said first facing edge having a notch located therein for admitting a first doorstop mounted on the first sidewall of the door frame and said second facing edge having a notch located therein for admitting a second doorstop mounted on the second sidewall of the door frame, said first head plate having a first arm connected thereto a side opposite said first facing edge and said second face plate having a second arm connected thereto at a side opposite said second facing edge, said first and second arms being adjustably engageable to establish a distance between said first facing edge and second acing edge which is one of a plurality of predetermined distances;

abutting said first facing edge of said first head plate against the first sidewall of the door frame with the doorstop on the first sidewall being accommodated within said notch in said first facing edge;

adjusting the engagement of said first and second arms to establish a distance between said first and second facing edges with is equal to the nominal width of a door to be installed in the door frame, said distance being adjustable to any one of a plurality of discreet, uniformly spaced-apart distances;

abutting said first facing edge of said second head plate against the second sidewall of the door frame with the doorstop o n the second sidewall being accommodated within said notch in said second facing edge; and anchoring the second sidewall of the door frame to the surface, the second sidewall being positioned at a precise separation from the first sidewall, as established by said door frame setter apparatus.

23. The apparatus as defined in claim 1, wherein said first and second head plates are arranged and configured to that they may be placed into engagement with the first and second sidewalls, respectively, at any position from the bottoms of the first and second sidewalls to a location near the tops of the first and second sidewalls.

24. The apparatus as defined in claim 1, wherein said plurality of discreet uniformly longitudinally spaced-apart distances comprises at least three different nominal standard widths of doors.

* * * * *

UNITED STATES PATENT AND TRADEMARK OFFICE

CERTIFICATE OF CORRECTION

PATENT NO. : 7,299,590 B2
APPLICATION NO. : 10/626412
DATED : November 27, 2007
INVENTOR(S) : Daniel B. Gibbs It is certified that error appears in the above-identified patent and that said Letters Patent is hereby corrected as shown below:

Col. 2, Line 58: “1186” should be --'186--

Col. 11, Line 10: “opposites” should be --opposite--

Col. 11, Line 12: “toward” should be --outward--

Col. 12, Line 2: “allowed he” should be --allow the--

Col. 12, Line 29: “si ad” should be --said--

Signed and Sealed this

Fifteenth Day of April, 2008

JON W. DUDAS
*Director of the United States Patent and Trademark Office*